US009874844B2

(12) United States Patent
Fujii et al.

(10) Patent No.: US 9,874,844 B2
(45) Date of Patent: Jan. 23, 2018

(54) IMAGE FORMING SYSTEM AND IMAGE FORMING APPARATUS

(71) Applicant: KONICA MINOLTA, INC., Chiyoda-ku, Tokyo (JP)

(72) Inventors: Ryosuke Fujii, Hachioji (JP); Masami Maruko, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/047,001

(22) Filed: Feb. 18, 2016

(65) Prior Publication Data

US 2016/0252837 A1 Sep. 1, 2016

(30) Foreign Application Priority Data

Feb. 26, 2015 (JP) ..... 2015-036258

(51) Int. Cl.
*G03G 15/00* (2006.01)

(52) U.S. Cl.
CPC ..... *G03G 15/6573* (2013.01); *G03G 15/5062* (2013.01)

(58) Field of Classification Search
CPC ..... G03G 15/0266; G03G 15/6576; G03G 15/6582
See application file for complete search history.

(56) References Cited

U.S. PATENT DOCUMENTS 5,765,074 A * 6/1998 Yasui ..... G03G 15/1655 399/49
2012/0045265 A1* 2/2012 Zaretsky ..... G03G 15/6573 399/405

FOREIGN PATENT DOCUMENTS

JP 2009001418 A 1/2009
JP 2011107374 A 6/2011
JP 2013227088 A 11/2013
JP 2014206690 A 10/2014

OTHER PUBLICATIONS

Japanese Notice of Reasons for Rejection corresponding to Application No. 2015-036258; dated Dec. 20, 2016, with English translation.

* cited by examiner

*Primary Examiner* — Hoang Ngo
(74) *Attorney, Agent, or Firm* — Cantor Colburn LLP

(57) ABSTRACT

An image forming system includes: an image forming apparatus configured to form an image on a paper sheet; a toner amount sensing device including a reading unit configured to read the paper sheet having the image formed thereon by the image forming apparatus; a charging device including a charging unit configured to electrically charge the paper sheet having the image formed thereon by the image forming apparatus; and a control unit configured to acquire an amount of toner adhering to the paper sheet by reading the paper sheet with the reading unit, and control the charging unit based on the amount of toner.

21 Claims, 10 Drawing Sheets

IMAGE FORMING SYSTEM AND IMAGE FORMING APPARATUS

The entire disclosure of Japanese Patent Application No. 2015-036258 filed on Feb. 26, 2015, including description, claims, drawings, and abstract are incorporated herein by reference in its entirety.

BACKGROUND OF THE INVENTION

Field of the Invention

The present invention relates to an image forming system including an image forming apparatus that forms an image by transferring toner images onto a paper sheet, and to the image forming apparatus.

Description of the Related Art

Electrophotographic image forming apparatuses have been known in the form of printers, copying machines, and the like. In such an image forming apparatus, static charge might be generated to electrically charge a paper sheet at the time of image formation or conveyance of the paper sheet. When electrically-charged paper sheets are ejected and stacked outside of the apparatus, defective stacking might occur due to repulsion force or absorption force generated between the paper sheets.

In an image forming apparatus, a latent image formed on a photosensitive drum is visualized through development with toner. Primary transfer is performed to transfer the visualized toner image from the photosensitive drum onto a transfer belt, and secondary transfer is performed to transfer the toner image from the transfer belt onto a paper sheet. In this manner, an image is formed on the paper sheet.

So as to transfer a toner image onto a paper sheet, a secondary transfer unit applies a positive voltage to the paper sheet from its back surface, for example. As a result, the paper sheet that has passed through the secondary transfer unit is negatively-charged on the image formation surface onto which toner is transferred, and is positively charged on its back surface.

FIGS. 13A to 13C are diagrams for explaining an example of paper sheet charging. An example case where two-side printing is performed on a paper sheet P is now described. First, as shown in FIG. 13A, when a toner image is transferred onto one surface P10, positive charge E11 is applied to the other surface P11, which is the surface on the opposite side from the image formation surface, and negative charge E12 is applied to the toner layer P10*a* transferred onto the one surface P10. The positive charge E11 moves toward the negative charge E12 in the paper sheet P.

As shown in FIG. 13B, when the paper sheet P is reversed so that the toner image is transferred onto the other surface P11, positive charge E21 is applied to the toner layer P10*a* on the one surface P10, and negative charge E22 is applied to the toner layer P11*a* transferred onto the other surface P11. If this situation is left as it is, mutual attraction occurs between the positive charge E21 and the negative charge E12, between the negative charge E12 and the positive charge E11, and between the positive charge E11 and the negative charge E22. As a result, the one surface P10 and the other surface P11 of the paper sheet P are charged with the opposite polarities from each other.

Further, as shown in FIG. 13C, when paper sheets P are stacked, the positive charge E21 on a toner layer P10*a* faces the negative charge E22 on a toner layer P11*a*, with a gap G being interposed in between. Because of the opposite polarities, the negative charge E22 gradually moves toward the surface, and a high-density charged portion is formed on the surface side. With this, mutual attraction force is generated between the stacked paper sheets P, and the paper sheets P are bonded to one another.

To counter this problem, there is a technology that involves a charging unit that electrically charges paper sheets prior to stacking. According to this technology, a correction voltage in accordance with the potential of a paper sheet prior to stacking is applied to the charging unit, so that the paper sheet is electrically charged (see JP 2009-001418 A and JP 2013-227088 A, for example).

The unit for sensing the potential of a paper sheet can acquire the potential of only part of the paper sheet. Therefore, even if the correction voltage in accordance with the potential of a paper sheet prior to stacking is applied to the charging unit, appropriate charging cannot be performed on all the surfaces of the paper sheet.

SUMMARY OF THE INVENTION

The present invention has been made so as to solve the above problem, and an object thereof is to provide an image forming system and an image forming apparatus that can electrically charge paper sheets in an appropriate manner.

To achieve the abovementioned object, according to an aspect, an image forming system reflecting one aspect of the present invention comprises: an image forming apparatus that forms an image on a paper sheet; a toner amount sensing device including a reading unit that reads the paper sheet having the image formed thereon by the image forming apparatus; a charging device including a charging unit that electrically charges the paper sheet having the image formed thereon by the image forming apparatus; and a control unit that acquires the amount of toner adhering to the paper sheet by reading the paper sheet with the reading unit, and controls the charging unit based on the amount of toner.

According to an invention of Item. 2, in the image forming system of Item. 1, the control unit preferably controls the charging of the paper sheet by acquiring the amount of toner adhering to one surface of the previous paper sheet, the amount of toner adhering to the other surface of the paper sheet facing the one surface of the previous paper sheet, the amount of toner adhering to one surface of the paper sheet, and the amount of toner adhering to the other surface of the following paper sheet facing the one surface of the paper sheet.

According to an invention of Item. 3, in the image forming system of Item. 1 or 2, the charging unit preferably includes charging rollers in the main scan direction of the paper sheet, and the control unit preferably applies voltage to the respective charging rollers with current values independent of one another.

According to an invention of Item. 4, in the image forming system of any one of Items. 1 to 3, the control unit preferably applies voltage to the charging unit with different current values while conveying the paper sheet.

According to an invention of Item. 5, in the image forming system of Item. 4, the distance between the charging unit and the reading unit in the conveying direction of the paper sheet is preferably equal to or greater than the maximum length of the paper sheet.

According to an invention of Item. 6, in the image forming system of any one of Items. 1 to 5, the control unit preferably acquires color information about the image by reading the paper sheet with the reading unit, and determines the amount of toner based on the color information.

According to an invention of Item. 7, in the image forming system of Item. 6, the charging device is preferably a line sensor extending in the width direction of the paper sheet.

According to an invention of Item. 8, in the image forming system of any one of Items. 1 to 7, the control unit preferably controls the charging unit based on whether the image is formed on the paper sheet.

According to an invention of Item. 9, in the image forming system of any one of Items. 1 to 8, based on the paper type and/or the basis weight of the paper sheet acquired by a paper information acquiring unit, the control unit preferably corrects the amount of toner acquired by the reading unit reading the image.

To achieve the abovementioned object, according to an aspect, an image forming apparatus reflecting one aspect of the present invention comprises: an image forming unit that forms an image on a paper sheet; a fixing unit that fixes the image to the paper sheet having the image formed thereon by the image forming unit; a reading unit that reads the paper sheet having the image fixed thereto by the fixing unit; a charging unit that electrically charges the paper sheet having the image fixed thereto by the fixing unit; and a control unit that acquires the amount of toner adhering to the paper sheet by reading the paper sheet with the reading unit, and controls the charging unit based on the amount of toner.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of an image forming system and an image forming apparatus of the present invention will be described with reference to the drawings. However, the scope of the invention is not limited to the illustrated examples.

Example Structure of an Image Forming System According to this Embodiment

Figure 1:
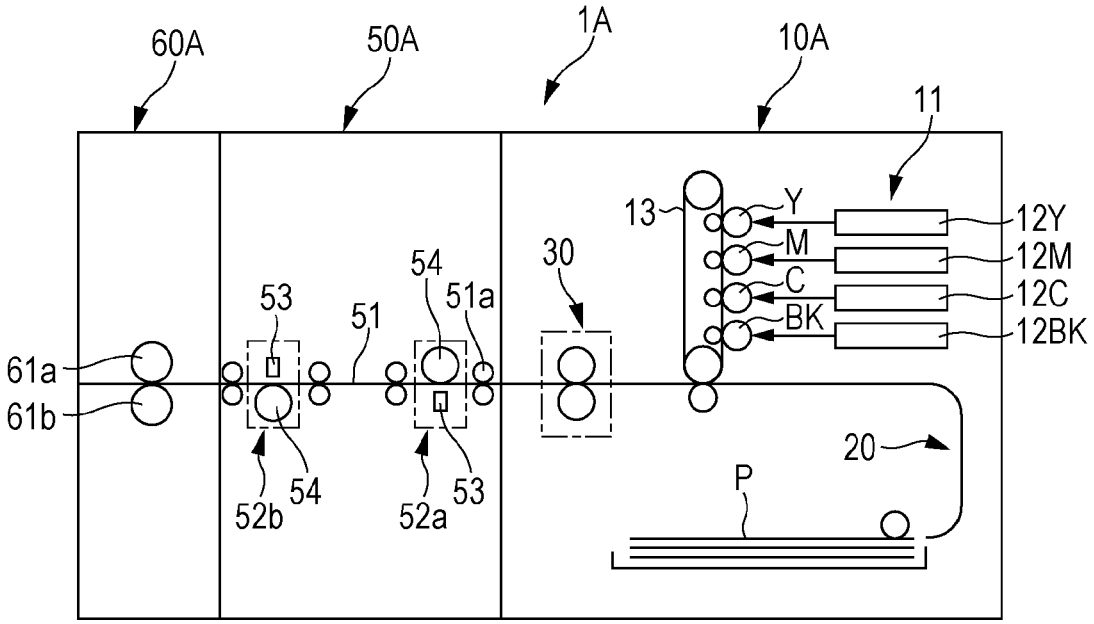
FIG. 1 is a diagram showing an example structure of an image forming system according to an embodiment.

FIG. 1 is a diagram showing an example structure of an image forming system according to this embodiment. The image forming system 1A according to this embodiment includes an image forming apparatus 10A that forms an image on a paper sheet, a toner amount sensing device 50A that senses the amount of toner adhering to the paper sheet, and a charging device 60A that electrically charges the paper sheet.

The image forming apparatus 10A includes an image forming unit 11, a paper conveying unit 20, and a fixing unit 30. In the image forming apparatus 10A, latent images are formed on respective photosensitive drums Y, M, C, and BK through scan exposure performed by optical writing units 12Y, 12M, 12C, and 12BK of the image forming unit 11. In the image forming unit 11, the latent images formed on the respective photosensitive drums Y, M, C, and BK are developed with toner, and are thus visualized.

In the image forming apparatus 10A, the toner images formed on the respective photosensitive drums Y, M, C, and BK are transferred onto an intermediate transfer belt 13 through primary transfer, and the toner images transferred onto the intermediate transfer belt 13 through the primary transfer are further transferred onto a paper sheet P being conveyed by the paper conveying unit 20 through secondary transfer.

In the image forming apparatus 10A, the paper sheet P is conveyed to the fixing unit 30 by the paper conveying unit 20, and the toner images are fixed to the paper sheet P, so that an image is formed on the paper sheet P. The image forming apparatus 10A then transports the paper sheet P having the image formed thereon in the paper conveying unit 20, and ejects the paper sheet P.

The toner amount sensing device 50A includes: a paper conveying unit 51 that includes conveying rollers 51*a* and conveys the paper sheet P ejected from the image forming apparatus 10A; a first sensing unit 52*a* that senses the amount of toner adhering to one surface (the lower surface) of the paper sheet P; and a second sensing unit 52*b* that senses the amount of toner adhering to the other surface (the upper surface) of the paper sheet P.

The first sensing unit 52*a* includes a reading unit 53 placed to face the lower surface of the paper sheet P being conveyed in the paper conveying unit 51, and a conveying roller 54 placed to face the reading unit 53. Meanwhile, the second sensing unit 52*b* includes a reading unit 53 placed to face the upper surface of the paper sheet P being conveyed in the paper conveying unit 51, and a conveying roller 54 placed to face the reading unit 53.

Figure 2:
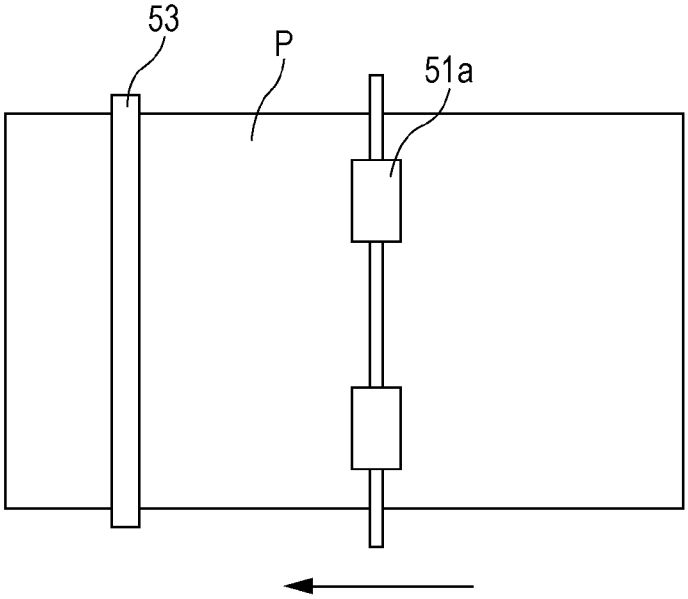
FIG. 2 is a diagram showing an example structure of a reading unit.

FIG. 2 is a diagram showing an example structure of each reading unit. Each reading unit 53 is an example of the toner sensing unit, and is formed with an optical reader that extends in the width direction of the paper sheet P. For example, each reading unit 53 is formed with a line sensor that has a sufficient length to read the entire paper sheet P in the width direction. The line sensor may be a CCD line sensor, so as to determine the amount of toner adhering to the paper sheet P based on color information about an image acquired by reading the paper sheet P.

While the paper conveying unit 51 is conveying the paper sheet P with the conveying rollers 51*a* in the direction indicated by the arrow, each reading unit 53 reads a surface of the paper sheet P. Accordingly, the first sensing unit 52*a* can sense a toner adhesion amount that is the amount of the toner adhering to the entire lower surface of the paper sheet P. Further, the second sensing unit 52*b* can sense a toner adhesion amount that is the amount of the toner adhering to the entire upper surface of the paper sheet P.

The charging device 60A includes a pair of charging rollers 61*a* and 61*b* that face each other, with the paper sheet P being interposed in between. The charging rollers 61*a* and 61*b* are an example of the charging unit. The charging rollers 61*a* and 61*b* each have an axis perpendicular to the conveying direction of the paper sheet P, and rotate in the conveying direction of the paper sheet P.

Figure 3:
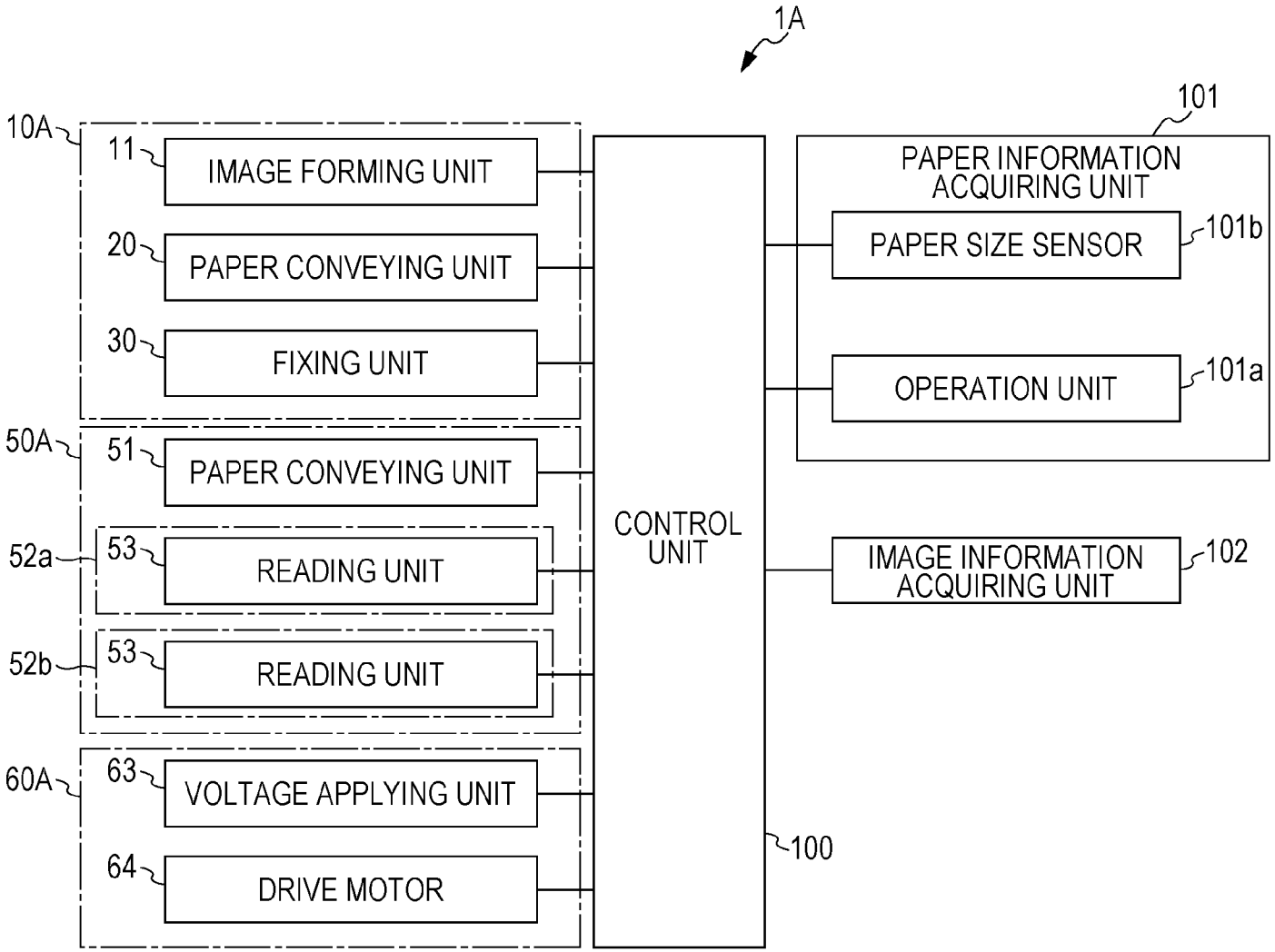
FIG. 3 is a functional block diagram showing an example control function of the image forming system according to the embodiment.

Example Functional Structure of the Image Forming System According to this Embodiment FIG. 3 is a functional block diagram showing an example control function of the image forming system according to this embodiment. Referring to FIG. 3, the control function related to the operation for controlling the surface potential of a paper sheet P based mainly on toner adhesion amounts is described.

The image forming system 1A includes a control unit 100 that feeds paper sheets P to the image forming apparatus 10A, and performs a series of controlling processes on image formation and paper ejection. The control unit 100 is an example of the control unit, and includes a microprocessor called a CPU or a MPU, and memories such as a RAM and a ROM as the storage unit.

The control unit 100 controls the paper conveying unit 20 in the image forming apparatus 10A to convey a paper sheet P. The control unit 100 controls the image forming unit 11 to form an image on the paper sheet P based on image data. Further, the control unit 100 controls the fixing unit 30 to fix the image to the paper sheet P, and ejects the paper sheet P having the image formed thereon.

The control unit 100 performs control so that the amount of toner adhering to the lower surface of the paper sheet P is obtained by the reading unit 53 in the first sensing unit 52*a* of the toner amount sensing device 50A, and the amount of the toner adhering to the upper surface of the paper sheet P is obtained by the reading unit 53 in the second sensing unit 52*b*. The control unit 100 also controls a voltage applying unit 63 in the charging device 60A based on the toner adhesion amounts of the paper sheet P, and controls the potential of the paper sheet P by applying a DC voltage or an AC superimposed voltage to the charging rollers 61*a* and 61*b* with a desired current value.

In the image forming apparatus 10A, static charge might be generated to electrically charge the paper sheet P at the time of image formation or conveyance of the paper sheet P. When the electrically-charged paper sheet P is ejected and stacked outside of the apparatus, defective stacking might occur due to repulsion force or absorption force generated between paper sheets.

Therefore, the image forming system 1A includes the charging device 60A that electrically charges the paper sheet P prior to the stacking. A correction voltage that can prevent bonding and repulsion between paper sheets is applied to the paper sheet P based on the amount of toner adhering to the paper sheet P, to electrically charge the paper sheet P. In this manner, bonding and repulsion between paper sheets are prevented, and defective stacking is avoided.

The control unit 100 determines the sign of the surface potential of the paper sheet P and the level of the potential based on paper information acquired by a paper information acquiring unit 101, such as the paper type, the basis weight, and the size of the paper sheet P, image information acquired by an image information acquiring unit 102, such as coverages, and the like.

The paper information acquiring unit 101 is an example of the paper information acquiring unit, and includes: an operation unit 101*a* as the operation unit through which the basis weight, the size, the paper type, and the like of the paper sheet P are selected; and a paper size sensor 101*b* that senses the size of the paper sheet P. The image information acquiring unit 102 is an example of the image information acquiring unit, and generates coverage information from the amounts of toner acquired by the toner amount sensing device 50A.

Figure 4:
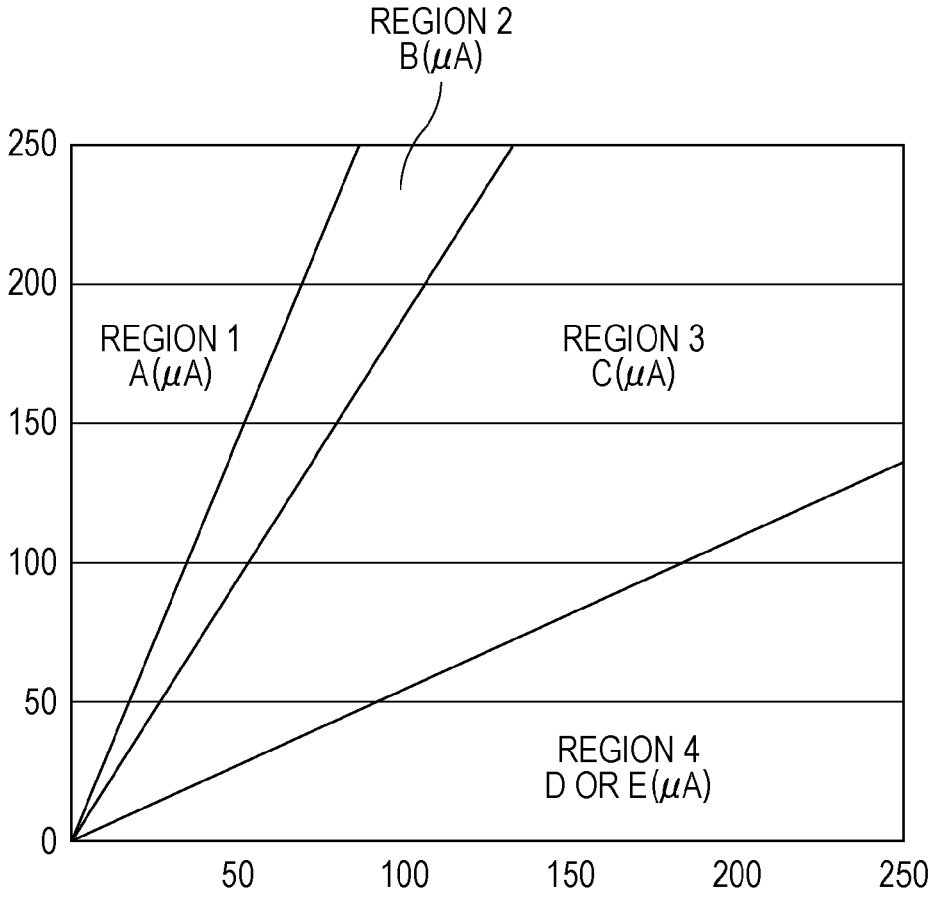
FIG. 4 is an explanatory diagram showing an example of a control table.

FIG. 4 is an explanatory diagram showing an example of a control table. The abscissa axis indicates the coverage (%) of the lower surface of a paper sheet P, and the ordinate axis indicates the coverage (%) of the upper surface of the paper sheet P. The coverages of both the front and back surfaces determine such a current value as to apply a desired voltage to the paper sheet P.

For example, a current value A (μA) is set in a region 1, a current value B (μA), which is greater than A (μA), is set in region 2, and a current value C (μA), which is greater than B (μA), is set in region 3. In region 4, a current value D (μA), which is greater than C (μA) and corresponds to the values of the coverages, or a current value E (μA), which is greater than D (μA) and corresponds to the values of the coverages, is set.

Example Operation of the Image Forming System According to this Embodiment

Figure 5:
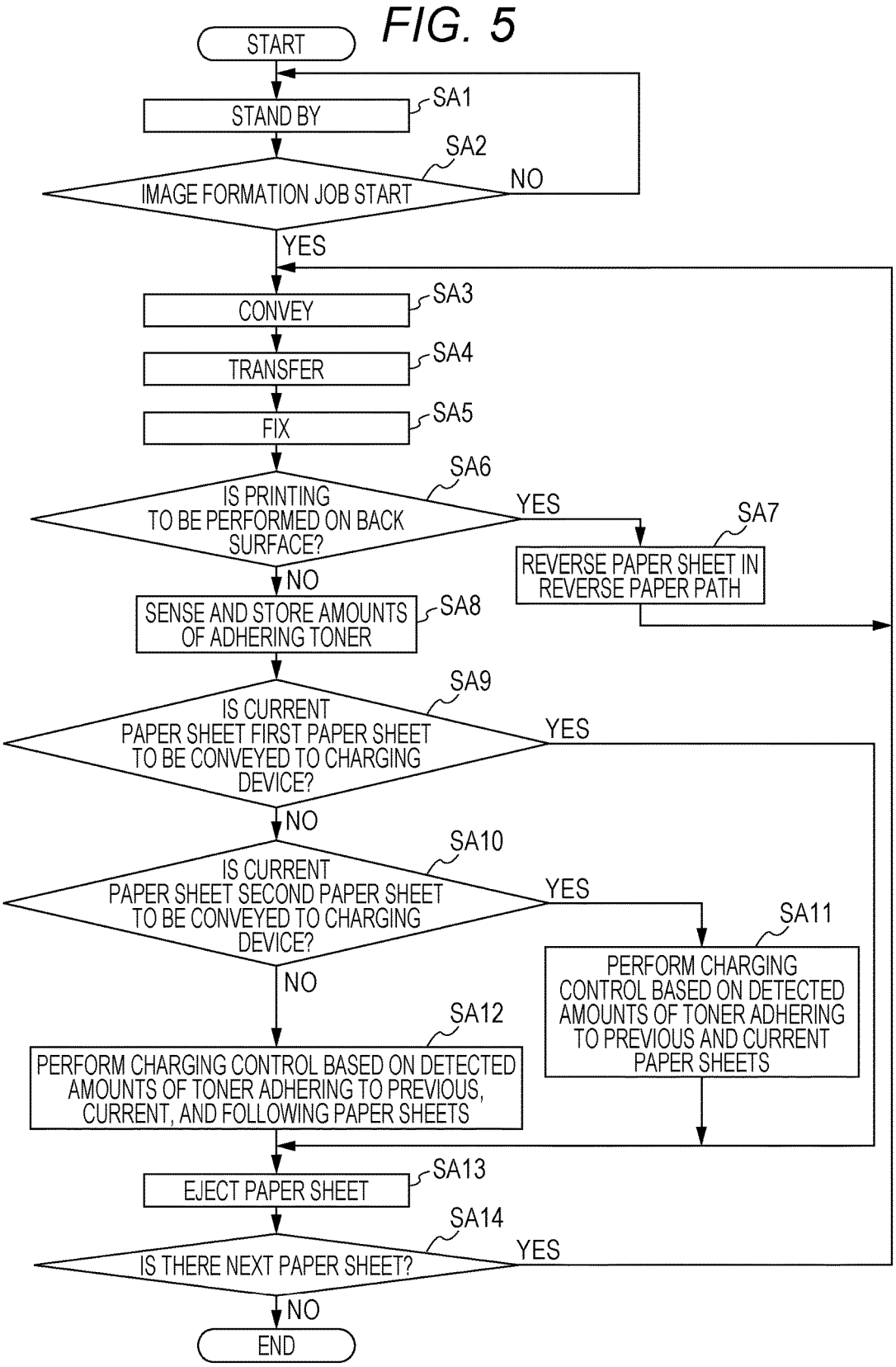
FIG. 5 is a flowchart showing an example operation of the image forming system according to the embodiment.

FIG. 5 is a flowchart showing an example operation of the image forming system according to this embodiment. In the description below, an example operation to be performed in the image forming system 1A according to this embodiment is explained.

In steps SA1 and SA2 shown in FIG. 5, the control unit 100 stands by until an instruction for an image formation job is issued. If an instruction for an image formation job is issued in step SA2, the control unit 100 controls the image forming apparatus 10A to form an image on a paper sheet P in steps SA3 to SA7 shown in FIG. 5. Specifically, the control unit 100 controls the paper conveying unit 20 to convey the paper sheet P in step SA3 shown in FIG. 5, controls the image forming unit 11 to transfer the image to the paper sheet P in step SA4, and controls the fixing unit 30 to fix the image to the paper sheet P in step SA5. The control unit 100 determines whether two-side printing is to be performed in step SA6 shown in FIG. 5. If the control unit 100 determines that two-side printing is to be performed, the control unit 100 reverses the paper sheet P in step SA7, so that an image is also formed on the back surface of the paper sheet.

In step SA8 shown in FIG. 5, the control unit 100 controls the first sensing unit 52*a* of the toner amount sensing device 50A to read the lower surface of the paper sheet P with the reading unit 53, and acquires and stores the amount of toner adhering to the lower surface of the paper sheet P. The control unit 100 also controls the second sensing unit 52*b* to read the upper surface of the paper sheet P with the reading unit 53, and acquires and stores the amount of toner adhering to the upper surface of the paper sheet P.

In step SA9 shown in FIG. 5, the control unit 100 determines whether the paper sheet P to be conveyed to the charging device 60A is the first paper sheet. If the control unit 100 determines that the paper sheet P to be conveyed to the charging device 60A is not the first paper sheet, the control unit 100 in step SA10 shown in FIG. 5 determines whether the paper sheet P to be conveyed to the charging device 60A is the second paper sheet.

If the control unit 100 determines that the paper sheet P to be conveyed to the charging device 60A is the second paper sheet, the control unit 100 in step SA11 shown in FIG. 5 controls the voltage applying unit 63 in the charging device 60A based on the amount of toner adhering to the current paper sheet P(n) that is the paper sheet from which an image is currently read to acquire and store the amount of toner adhering thereto, and the amount of toner adhering to the previous paper sheet P(n−1) that is the paper sheet from which an image has been read immediately before the current P(n) to acquire and store the amount of toner adhering thereto. The control unit 100 then controls the potential of the paper sheet P by applying a DC voltage or an AC superimposed voltage to the charging rollers 61*a* and 61*b* with a desired current value.

If the control unit 100 determines that the paper sheet P to be conveyed to the charging device 60A is not the second paper sheet, the control unit 100 in step SA12 shown in FIG. 5 controls the voltage applying unit 63 in the charging device 60A based on the amount of toner adhering to the current paper sheet P(n), the amount of toner adhering to the previous paper sheet P(n−1), and the amount of toner adhering to the following paper sheet P(n+1) that is the paper sheet from which an image is read immediately after the current paper sheet P(n) to acquire and store the amount of toner adhering thereto. The control unit 100 then controls the potential of the paper sheet P by applying a DC voltage or an AC superimposed voltage to the charging rollers 61*a* and 61*b* with a desired current value.

If the control unit 100 determines that the paper sheet P to be conveyed to the charging device 60A is the first paper sheet, the control unit 100 ejects the paper sheet P in step SA13 shown in FIG. 5. In step SA14 shown in FIG. 5, the control unit 100 determines whether there is the next paper sheet on which an image is to be formed through a continuous process. If the control unit 100 determines that there is the next paper sheet, the control unit 100 returns to the procedure in step SA4.

In the image forming system 1A according to this embodiment, charge control is performed based on the amounts of toner adhering to all the surfaces of each paper sheet P. Accordingly, appropriate charging can be performed on all the surfaces of each paper sheet, bonding and repulsion between paper sheets can be prevented, and defective stacking can be avoided.

It should be noted that toner amounts acquired by reading images with the reading units 53 based on the paper type and/or the basis weight of a paper sheet P acquired by the paper information acquiring unit 101 may be corrected.

Example Application of the Image Forming System According to this Embodiment

As described above, in this embodiment, the amounts of toner adhering to all the surfaces of a paper sheet P can be acquired. Therefore, in an operation to electrically charge a paper sheet P, the charge amount may be controlled in an appropriate position on the paper sheet P.

Figure 6:
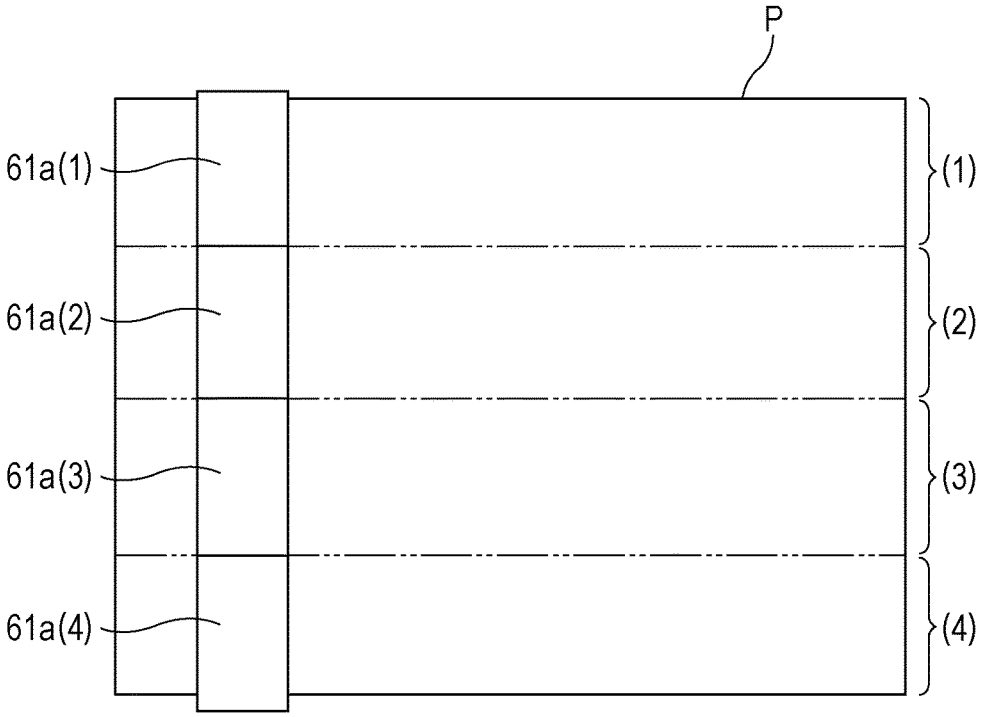
FIG. 6 is a diagram showing the structure of a modification of charging rollers.

FIG. 6 is a diagram showing the structure of a modification of the charging rollers. The charging rollers are provided in the main scan direction, which is the width direction of the paper sheet P. In this example, four charging rollers 61*a*(1), 61*a*(2), 61*a*(3), and 61*a*(4) are provided on the same axis. A DC voltage or an AC superimposed voltage is applied to each charging roller with an individual current value.

With this, different portions of the paper sheet P in the width direction can be electrically charged with different potentials. In this example, a region (1), a region (2), a region (3), and a region (4) of the paper sheet P can be made to have different potentials. Accordingly, appropriate charging can be performed even in a case where the amount of toner adhering to the surfaces of the paper sheet varies, and the degrees of bonding and repulsion vary among the regions of the paper sheet.

Figure 7A:
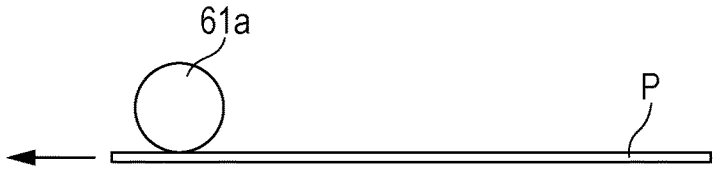
FIGS. 7A to 7C are diagrams showing another example operation of the charging rollers.
Figure 7B:
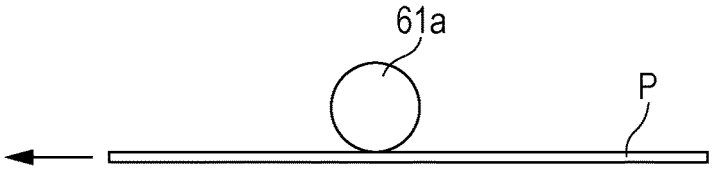
Figure 7C:
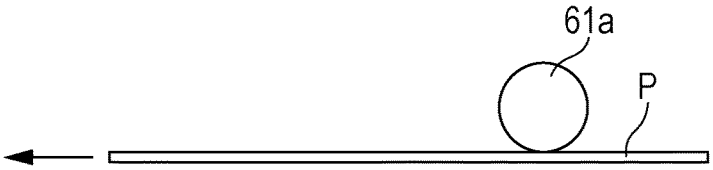

FIGS. 7A to 7C are diagrams showing another example operation of the charging rollers. While a paper sheet P is conveyed in a sub scan direction that is the conveying direction indicated by arrows, a DC voltage or an AC superimposed voltage is applied to a charging roller with different current values in the respective positions shown in FIGS. 7A to 7C.

With this, different portions of the paper sheet P in the width direction can be electrically charged with different potentials in the conveying direction of the paper sheet P. Accordingly, appropriate charging can be performed even in a case where the amount of toner adhering to the surfaces of the paper sheet varies, and the degrees of bonding and repulsion vary among the regions of the paper sheet.

Where divided charging rollers are provided as shown in FIG. 6, and the voltage to be applied can be arbitrarily controlled during the conveyance of a paper sheet P as shown in FIGS. 7A to 7C, different portions of the paper sheet P both in the width direction and the conveying direction can be electrically charged with different potentials.

Figure 8:
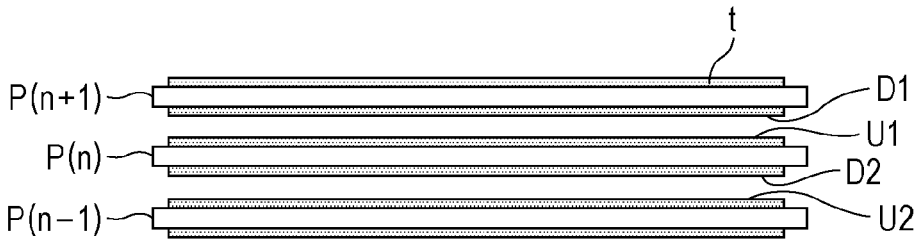
FIG. 8 is a diagram for explaining a stacked state of paper sheets.

FIG. 8 is a diagram for explaining a stacked state of paper sheets. As described above with reference to the flowchart, in a case where three or more paper sheets are stacked, it is necessary to be able to control the potential of the lower surface D1 of the following paper sheet P(n+1), the potential of the upper surface U1 of the current paper sheet P(n), the potential of the lower surface D2 of the current paper sheet P(n), and the potential of the upper surface U2 of the previous paper sheet P(n−1).

Figure 9:
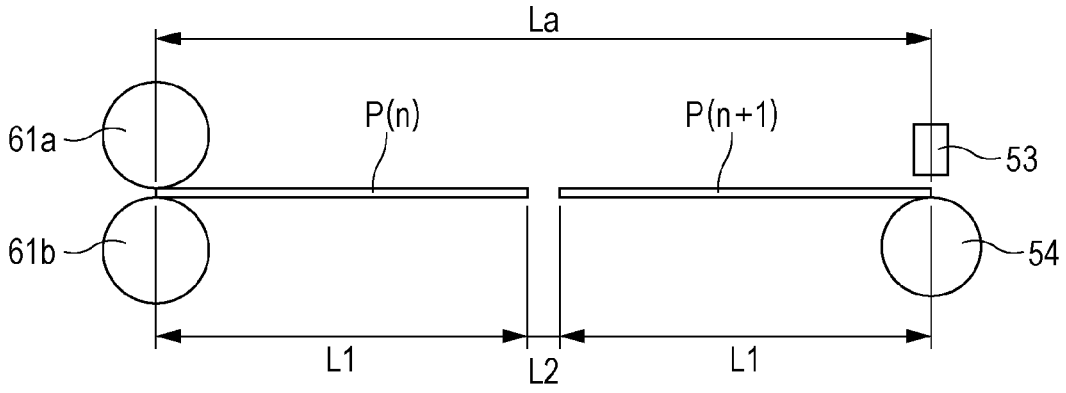
FIG. 9 is an explanatory diagram showing an example of arrangement of charging rollers and a reading unit.

The potential of a preceding paper sheet needs to be controlled after the amount t of toner adhering to the following paper sheet is acquired. FIG. 9 is an explanatory diagram showing an example of arrangement of charging rollers and a reading unit. In a structure where the current value for the voltage to be applied cannot be controlled while charging is performed by the charging rollers 61*a* and 61*b*, the potential of the preceding current paper sheet P(n) needs to be controlled after the following paper sheet P(n+1) is read to acquire a toner amount by the reading unit 53.

Therefore, a distance equivalent to the value obtained by adding the inter-sheet distance to twice the maximum length of paper sheets P needs to be maintained between the reading unit 53 and the charging rollers 61*a* and 61*b*. That is, where L1 represents the maximum length of paper sheets P, and L2 represents the inter-sheet distance, the distance La between the reading unit 53 and the charging rollers 61*a* and 61*b* needs to be the distance expressed as: $La=2\times L1+L2$.

Figure 10:
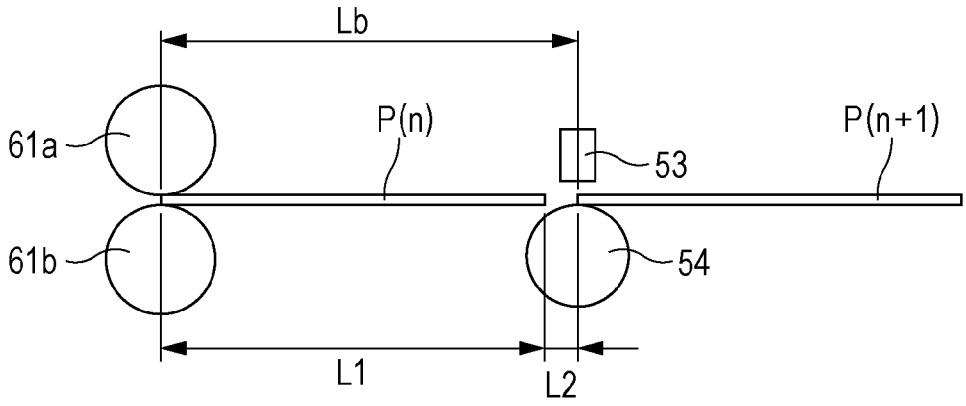
FIG. 10 is an explanatory diagram showing another example of arrangement of charging rollers and a reading unit.

FIG. 10 is an explanatory diagram showing another example of arrangement of charging rollers and a reading unit. As described above with reference to FIGS. 7A to 7C, in a structure where the current value for the voltage to be applied can be controlled while charging is performed by the charging rollers 61*a* and 61*b*, the potential of the preceding current paper sheet P (n) can be controlled before the following paper sheet P(n+1) is read to acquire a toner amount by the reading unit 53.

In this case, the distance between the reading unit 53 and the charging rollers 61*a* and 61*b* is equivalent to the value obtained by adding the inter-sheet distance to the maximum length of paper sheets P. That is, where L1 represents the maximum length of paper sheets P, and L2 represents the inter-sheet distance, the distance Lb between the reading unit 53 and the charging rollers 61*a* and 61*b* needs to be the distance expressed as: Lb=L1+L2.

Accordingly, in a structure where the current value for the voltage to be applied can be controlled while charging is performed by the charging rollers 61*a* and 61*b*, the distance between the reading unit 53 and the charging rollers 61*a* and 61*b* can be made shorter.

Figure 11:
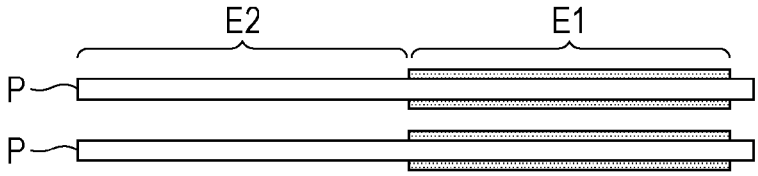
FIG. 11 is an explanatory diagram showing the relationship between an image formation position and a charging operation.

FIG. 11 is an explanatory diagram showing the relationship between an image formation position and a charging operation. Bonding and repulsion between paper sheets do not easily occur in a region on each paper sheet P where any image is not formed, or in a region having no toner adhering thereto. In view of this, on each paper sheet P, a region E1 having images formed therein and a region E2 not having any image formed therein are determined from image formation information and toner adhesion amounts. In a charging operation, any voltage is not applied while the charging rollers 61*a* and 61*b* are in contact with the region E2 not having any image formed therein. With this, the durability of the charging rollers 61*a* and 61*b* can be increased. If there is no bonding due to charging, stacked paper sheets can be separated from one another by air blow.

Figure 12:
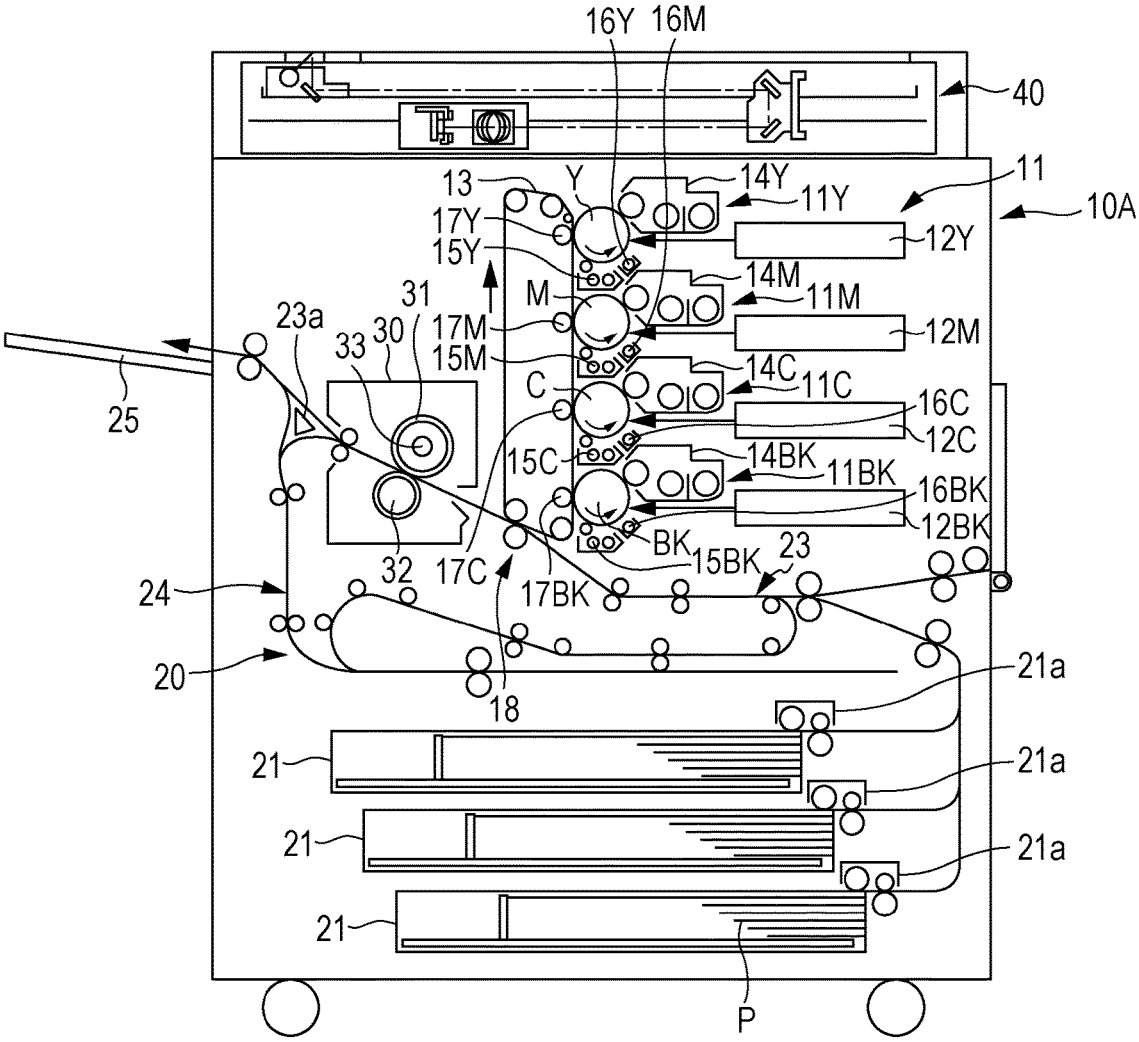
FIG. 12 is a diagram showing an example structure of the image forming apparatus according to this embodiment.
Figure 13A:
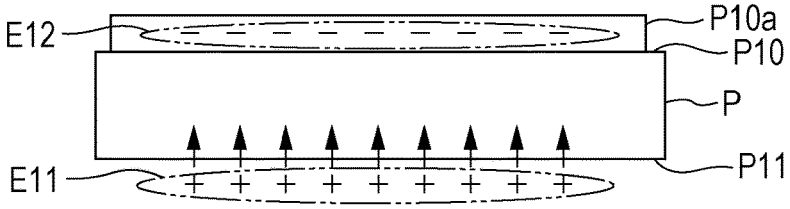
FIGS. 13A to 13C are diagrams for explaining an example of paper sheet charging.
Figure 13B:
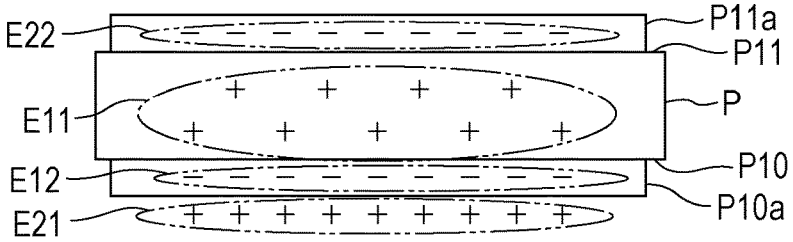
Figure 13C:
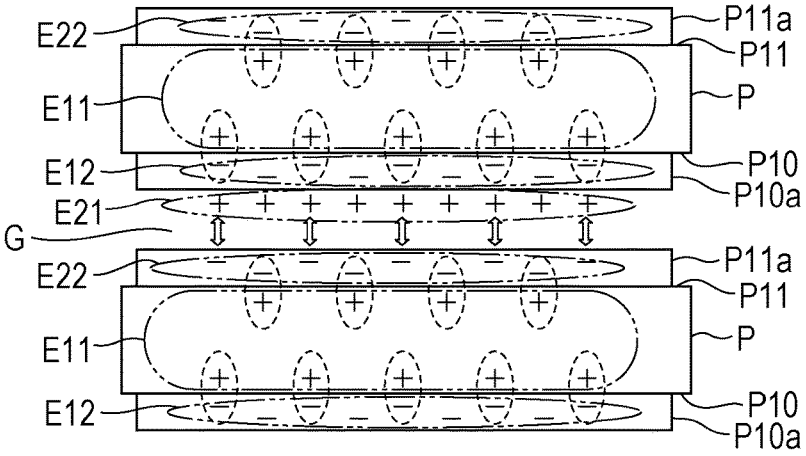

Example Structure of the Image Forming Apparatus According to this Embodiment FIG. 12 is a diagram showing an example structure of the image forming apparatus according to this embodiment. The image forming apparatus 10A includes the image forming unit 11, the paper conveying unit 20, the fixing unit 30, and a document reading unit 40.

The image forming unit 11 is an example of the image forming unit, and includes an image forming unit 11Y that forms an image in yellow (Y), an image forming unit 11M that forms an image in magenta (M), an image forming unit 11C that forms an image in cyan (C), and an image forming unit 11BK that forms an image in black (BK).

The image forming unit 11Y includes a photosensitive drum Y, and a charging unit 16Y, an optical writing unit 12Y, a development device 14Y, and a drum cleaner 15Y that are arranged around the photosensitive drum Y. Likewise, the image forming units 11M, 11C, and 11BK includes photosensitive drums M, C, and BK, and charging units 16M, 16C, and 16BK, optical writing units 12M, 12C, and 12BK, development devices 14M, 14C, and 14BK, and drum cleaners 15M, 15C, and 15BK that are arranged around the photosensitive drums M, C, and BK, respectively.

The surface of the photosensitive drum Y is uniformly charged by the charging unit 16Y, and a latent image is formed on the photosensitive drum Y through scan exposure performed by the optical writing unit 12Y. Further, the development device 14Y conducts development with toner, to visualize the latent image on the photosensitive drum Y. As a result, an image in a predetermined color corresponding to yellow (a toner image) is formed on the photosensitive drum Y.

Likewise, the surface of the photosensitive drum M is uniformly charged by the charging unit 16M, and a latent image is formed on the photosensitive drum M through scan exposure performed by the optical writing unit 12M. Further, the development device 14M conducts development with toner, to visualize the latent image on the photosensitive drum M. As a result, a toner image in a predetermined color corresponding to magenta is formed on the photosensitive drum M.

The surface of the photosensitive drum C is uniformly charged by the charging unit 16C, and a latent image is formed on the photosensitive drum C through scan exposure performed by the optical writing unit 12C. Further, the development device 14C conducts development with toner, to visualize the latent image on the photosensitive drum C. As a result, a toner image in a predetermined color corresponding to cyan is formed on the photosensitive drum C.

The surface of the photosensitive drum BK is uniformly charged by the charging unit 16BK, and a latent image is formed on the photosensitive drum BK through scan exposure performed by the optical writing unit 12BK. Further, the development device 14BK conducts development with toner, to visualize the latent image on the photosensitive drum BK. As a result, a toner image in a predetermined color corresponding to black is formed on the photosensitive drum BK.

The images formed on the photosensitive drums Y, M, C, and BK are sequentially transferred to a predetermined position on the intermediate transfer belt 13, which is a belt-like intermediate transfer member, by primary transfer rollers 17Y, 17M, 17C, and 17BK. The image formed with the respective colors transferred onto the intermediate transfer belt 13 is further transferred by a secondary transfer unit 18 onto a paper sheet P being conveyed at a predetermined timing by the paper conveying unit 20.

In this example, the paper conveying unit 20 includes paper feed trays 21 that store paper sheets P, and sheet feeding units 21*a* that feed the paper sheets P stored in the paper feed trays 21. The paper conveying unit 20 also includes a principal paper path 23 in which the paper sheets P fed from the paper feed trays 21, a reverse paper path 24 that reverse the paper sheets P, and a paper receiving tray 25 onto which the paper sheets P are ejected.

In the paper conveying unit 20, on the downstream side of the fixing unit 30, the reverse paper path 24 branches from the principal paper path 23, and a switch gate 23*a* is provided at the branching point between the principal paper path 23 and the reverse paper path 24. In the image forming apparatus 10A, a paper sheet P that has been conveyed in the principal paper path 23 and has passed through the secondary transfer unit 18 and the fixing unit 30 has an image formed on the surface facing upward. In a case where images are formed on both sides of a paper sheet P, the paper sheet P having an image formed on the one surface facing upward is conveyed from the principal paper path 23 to the reverse paper path 24, and is then conveyed from the reverse paper path 24 to the principal paper path 23, so that the surface having the image formed thereon faces downward. The paper sheet P is reversed in this manner, and an image can be formed on the other surface facing upward.

The fixing unit 30 is an example of the fixing unit, and performs an image fixing process on a paper sheet P having images transferred thereto. The fixing unit 30 conveys a paper sheet P, and fixes images to the paper sheet P by performing pressure fixing with a pair of fixing rollers 31 and 32 and performing heat fixing with a fixing heater 33.

The document reading unit 40 performs scan exposure on an image of a document with an optical system of a scan exposure device, and obtains an image signal by reading the reflected light with a line image sensor. Alternatively, the image forming apparatus 10A may have a structure in which an automatic sheet feeder (not shown) that feeds documents is provided in an upper portion.

So as to form the image forming system 1A, the toner amount sensing device 50A and the charging device 60A, which have been described as post processing devices, may be connected to the image forming apparatus 10A having the above described structure. Alternatively, the image forming apparatus 10A may include the toner amount sensing device 50A and the charging device 60A so that the image forming apparatus 10A can perform control to detect the amount of toner adhering to a paper sheet P, and can perform control to electrically charge the paper sheet P in accordance with the amount of toner.

The present invention is applied to image forming apparatuses that electrically charge paper sheets and transfer toner images onto the paper sheets.

Although the present invention has been described and illustrated in detail, it is clearly understood that the same is by way of illustrated and example only and is not to be taken byway of limitation, the scope of the present invention being interpreted by terms of the appended claims.

What is claimed is:

1. An image forming system to stack paper sheets on which an image is formed, the image forming system comprising:

an image forming apparatus configured to form a toner image on a sheet and to fix the toner image on the sheet by a fixing device;

a stacker configured to stack sheets on which the toner image is formed and fixed;

a toner amount sensing device including a reading unit configured to read the toner image fixed on the sheet to obtain an amount of toner adhering to the sheet after the toner image is formed and fixed by the image forming apparatus;

a charging device including a charging unit provided between the fixing device and the stacker and configured to electrically charge the sheet which is conveyed after the toner image is formed and fixed by the image forming apparatus and before stacking on the stacker; and a control unit configured to acquire the amount of toner adhering to the sheet by reading the sheet with the reading unit, and control the charging unit based on the amount of toner.

2. The image forming system according to claim 1, wherein the control unit controls the charging of the paper sheet by acquiring an amount of toner adhering to one surface of a previous paper sheet, an amount of toner adhering to the other surface of the paper sheet facing the one surface of the previous paper sheet, an amount of toner adhering to one surface of the paper sheet, and an amount of toner adhering to the other surface of a following paper sheet facing the one surface of the paper sheet.

3. The image forming system according to claim 1, wherein the charging unit includes a plurality of charging rollers in a main scan direction of the paper sheet, and the control unit applies voltage to the respective charging rollers with current values independent of one another.

4. The image forming system according to claim 1, wherein the control unit applies voltage to the charging unit with different current values while conveying the paper sheet.

5. The image forming system according to claim 4, wherein a distance between the charging unit and the reading unit in a conveying direction of the paper sheet is equal to or greater than the maximum length of the paper sheet.

6. The image forming system according to claim 1, wherein the control unit acquires color information about the image by reading the paper sheet with the reading unit, and determines the amount of toner based on the color information.

7. The image forming system according to claim 6, wherein the charging device is a line sensor extending in a width direction of the paper sheet.

8. The image forming system according to claim 1, wherein the control unit controls the charging unit based on whether the image is formed on the paper sheet.

9. The image forming system according to claim 1, wherein, based on a paper type and/or a basis weight of the paper sheet acquired by a paper information acquiring unit, the control unit corrects the amount of toner acquired by the reading unit reading the image.

10. The image forming system according to claim 1, wherein the charging device is provided at a position that charge the paper sheet which is discharged from the image forming apparatus after the image formation.

11. The image forming system according to claim 1, wherein the charging device is different from a transfer device which transfers the toner image on the sheet in the image forming apparatus.

12. An image forming apparatus to stack paper sheets on which an image is formed, the image forming apparatus comprising:

an image forming unit configured to form a toner image on a sheet;

a fixing unit configured to fix the toner image to the sheet having the image formed thereon by the image forming unit;

a stacker configured to stack sheets on which the toner image is formed and fixed;

a reading unit configured to read the toner image fixed on the sheet to obtain an amount of toner adhering to the sheet after the toner image fixed is thereto by the fixing unit;

a charging unit configured to be provided between the fixing unit and the stacker and to electrically charge the sheet which is conveyed after the image fixation by the fixing unit and before stacking; and a control unit configured to acquire the amount of toner adhering to the sheet by reading the sheet with the reading unit, and control the charging unit based on the amount of toner.

13. The image forming system according to claim 12, wherein the control unit controls the charging of the paper sheet by acquiring an amount of toner adhering to one surface of a previous paper sheet, an amount of toner adhering to the other surface of the paper sheet facing the one surface of the previous paper sheet, an amount of toner adhering to one surface of the paper sheet, and an amount of toner adhering to the other surface of a following paper sheet facing the one surface of the paper sheet.

14. The image forming system according to claim 12, wherein the charging unit includes a plurality of charging rollers in a main scan direction of the paper sheet, and the control unit applies voltage to the respective charging rollers with current values independent of one another.

15. The image forming system according to claim 12, wherein the control unit applies voltage to the charging unit with different current values while conveying the paper sheet.

16. The image forming system according to claim 15, wherein a distance between the charging unit and the reading unit in a conveying direction of the paper sheet is equal to or greater than the maximum length of the paper sheet.

17. The image forming system according to claim 12, wherein the control unit acquires color information about the image by reading the paper sheet with the reading unit, and determines the amount of toner based on the color information.

18. The image forming system according to claim 17, wherein the charging device is a line sensor extending in a width direction of the paper sheet.

19. The image forming system according to claim 12, wherein the control unit controls the charging unit based on whether the image is formed on the paper sheet.

20. The image forming system according to claim 12, wherein, based on a paper type and/or a basis weight of the paper sheet acquired by a paper information acquiring unit, the control unit corrects the amount of toner acquired by the reading unit reading the image.

21. The image forming apparatus according to claim 12, wherein a charging device of the charging unit is different from a transfer device which transfers the toner image on the sheet in the image forming unit.

* * * * *